US009677221B2

(12) United States Patent
Schneiders et al.

(10) Patent No.: US 9,677,221 B2
(45) Date of Patent: Jun. 13, 2017

(54) METHOD AND DEVICE FOR IMPREGNATING A ROPE WITH A LIQUID MATERIAL

(71) Applicant: DSM IP ASSETS B.V., Heerlen (NL)

(72) Inventors: Hans Schneiders, Echt (NL); Stefan Beckers, Echt (NL)

(73) Assignee: DSM IP ASSETS B.V., Heerlen (NL)

( * ) Notice: Subject to any disclaimer, the term of this patent is extended or adjusted under 35 U.S.C. 154(b) by 218 days.

(21) Appl. No.: 14/382,391

(22) PCT Filed: Mar. 1, 2013

(86) PCT No.: PCT/EP2013/054189
§ 371 (c)(1),
(2) Date: Sep. 2, 2014

(87) PCT Pub. No.: WO2013/128006
PCT Pub. Date: Sep. 6, 2013

(65) Prior Publication Data

US 2015/0101306 A1 Apr. 16, 2015

(30) Foreign Application Priority Data

Mar. 1, 2012 (EP) ..... 12157761

(51) Int. Cl.
*D06M 15/715* (2006.01)
*D07B 7/12* (2006.01)
(Continued)

(52) U.S. Cl.
CPC ..... *D06M 15/715* (2013.01); *D04C 1/12* (2013.01); *D06M 15/19* (2013.01); *D07B 1/16* (2013.01);
(Continued)

(58) Field of Classification Search
CPC ..... D06M 15/715; D04C 1/12; D07B 1/16; D07B 7/12
See application file for complete search history.

(56) References Cited

U.S. PATENT DOCUMENTS

| | | | | |
|---|---|---|---|---|
| 1,587,652 | A | 6/1926 | Johnston | |
| 3,885,380 | A * | 5/1975 | Hacker | H01B 11/02 118/44 |
| 3,889,455 | A * | 6/1975 | Portinari | H01B 13/328 156/48 |
| 3,923,003 | A * | 12/1975 | Carden | B05C 3/15 118/405 |
| 4,490,969 | A * | 1/1985 | Simpson | D07B 1/144 57/217 |

(Continued)

FOREIGN PATENT DOCUMENTS

| | | |
|---|---|---|
| CA | 768 356 | 10/1967 |
| DE | 749 220 | 11/1944 |
| DE | 42 03 706 | 3/1993 |
| EP | 0 200 547 | 11/1986 |
| EP | 0 205 960 | 12/1986 |
| EP | 0 213 208 | 3/1987 |
| EP | 0 472 114 | 4/1999 |
| EP | 13 50 868 | 10/2003 |
| GB | 789 163 | 1/1958 |
| GB | 2 042 414 | 9/1980 |
| GB | 2 051 667 | 1/1981 |
| JP | 48-041094 | 6/1973 |
| JP | 55-102457 | 8/1980 |
| JP | 2005-264358 | 9/2005 |
| WO | WO 01/73173 | 10/2001 |

(Continued)

OTHER PUBLICATIONS

International Search Report for PCT/EP2013/054189, mailed Aug. 13, 2013.

(Continued)

*Primary Examiner* — Shaun R Hurley
(74) *Attorney, Agent, or Firm* — Nixon & Vanderhye P.C.

(57) ABSTRACT

Methods for impregnating a liquid material into a rope are provided whereby a liquid material is provided in a tank which defines the liquid level in the tank. An impregnation unit containing a chamber at least partially immersed in the liquid material includes a vacuum-device operatively connected to the vacuum-outlet of the chamber so as to lower the pressure in the chamber below atmospheric pressure. The rope may therefore be passed through the liquid material in the tank and then inside and outside the chamber via the rope-inlet and rope-outlet of the chamber, while maintaining the pressure inside the chamber below the atmo- (Continued)

spheric pressure to thereby force the liquid material to fill at least part of the interstices between the fibers of the rope by penetrating between the fibers.

18 Claims, 2 Drawing Sheets

(51) Int. Cl.

| | |
|---|---|
| ***D04C 1/12*** | (2006.01) |
| ***D06M 15/19*** | (2006.01) |
| ***D07B 1/16*** | (2006.01) |
| *D07B 1/02* | (2006.01) |
| *D06M 101/18* | (2006.01) |

(52) U.S. Cl.
CPC ..... *D07B 7/12* (2013.01); *D06M 2101/18* (2013.01); *D07B 1/025* (2013.01); *D07B 2201/2081* (2013.01); *D07B 2205/10* (2013.01); *D07B 2205/205* (2013.01); *D07B 2205/2014* (2013.01); *D07B 2501/2038* (2013.01); *D07B 2501/2061* (2013.01); *D07B 2501/2092* (2013.01); *D10B 2401/063* (2013.01)

(56) References Cited

U.S. PATENT DOCUMENTS 4,623,504 A * 11/1986 Smith ..... B29C 47/02 156/244.21
6,165,586 A 12/2000 Nouveau et al.

FOREIGN PATENT DOCUMENTS

WO WO 2005/066401 7/2005
WO WO 2010/013108 2/2010

OTHER PUBLICATIONS

Nakajima et al., "Advanced Fiber Spinning Technology", Woodhead Publ. Ltd., (1994), 21 pages.

* cited by examiner

METHOD AND DEVICE FOR IMPREGNATING A ROPE WITH A LIQUID MATERIAL

This application is the U.S. national phase of International Application No. PCT/EP2013/054189, filed on 1 Mar. 2013, which designated the U.S. and claims priority EP Application No. 12157761.3, filed on 1 Mar. 2012, the entire contents of each of which are hereby incorporated by reference.

The invention relates to a method for impregnating a rope with a liquid material. The invention further relates to a device for carrying out the same.

BACKGROUND OF THE INVENTION

It has been the universal commercial practice to pass a rope slowly through a bath of liquid material to permit the material to penetrate the voids or interstices of the rope. Such a method and a device for carrying out the method are known from U.S. Pat. No. 3,960,050 wherein the rope is placed in a basket which is immersed in an impregnation tank containing the liquid material to be impregnated in the rope. Alternatively, the rope may be passed through an impregnation bath containing said liquid. U.S. Pat. No. 3,960,050 also describes a device for carrying out the method disclosed therein. Further methods for impregnating a rope and devices for carrying out said methods are known from U.S. Pat. No. 4,197,695 wherein an impregnation bath or an impregnation closing die are used; U.S. Pat. No. 4,490,969 wherein an impregnation bath or a spraying device are used; U.S. Pat. No. 5,098,493 wherein injection needles are used; and U.S. Pat. No. 4,635,432 wherein an injection die is used.

Another device for impregnation is disclosed for example in U.S. Pat. No. 1,587,652 which is used to saturate a fibrous material in particular a felt sheet with e.g. asphalt. The device disclosed therein contains a pressure saturating chamber which uses high pressure, i.e. pressure higher than the atmospheric pressure, to cause the asphalt to penetrate the sheet. After saturating or impregnating the sheet using high pressure, the device may subsequently use vacuum to extract any moisture or air trapped therein; and then the sheet may be again subjected to saturation under great pressure. Vacuum however is not used during the saturation step.

CA 768356 also discloses a device for impregnating a textile, the device comprising an impregnation bath containing an impregnant and a vacuumed column located within the impregnant such that the impregnant acts as a seal for the bottom of the column. Just as in U.S. Pat. No. 1,587,652, vacuum is used to extract any air which may be retained within the impregnated textile. A device similar to the one of CA 768356 is disclosed by JP 48-41094.

Another disclosure of a device for impregnating a wire rope is given by JP 2005 264358. The device disclosed therein operates in a batch-like fashion wherein a portion of a length of the wire rope is placed in a vacuumed tube and a molten resin is injected under pressure in said tube, to impregnate said portion. After impregnation, the vacuum is released, the impregnated portion of the rope is removed from the tube and a portion of the adjacent non-impregnated part of the rope is placed in the tube. The operation is repeated to impregnate the complete length of the rope.

Moreover, although impregnating a rope and coating a rope are in principle two different processes with different characteristics, in some instances is arguable that the methods for coating a rope may also achieve some low degree of impregnation. A method for coating a rope is described for example in JP 5 510 2457, wherein the rope is coated with grease by injecting the grease into a chamber while the chamber moves along the length of the rope. The thickness of coated grease is controlled by the size of the gap between the outer periphery of the rope and the internal periphery of the outlet of the chamber which discharges the rope. Further methods for coating ropes wherein some degree of impregnation may be achieved are known from U.S. Pat. No. 4,067,211 wherein a spraying method is used for coating the rope; and U.S. Pat. No. 8,105,657 wherein a coating chamber is used.

It was however noticed that the results obtained with the known impregnation or coating methods may depend on the modus operandi, or in other words, to the skills of the operator, i.e. the person carrying out the method. The rather poor reproducibility of such methods typically implies that the quality of the impregnation may vary with the skills of the operator and in turn, impregnated ropes forming for example a rope batch may have inconsistent properties. Also due to the employment of complicated machinery and/or heavy hardware, the known methods may be cumbersome to use and even pose safety risks.

It was also noticed that the above mentioned methods have difficulties in achieving an optimum degree of impregnation; in particular since the liquid material does not always optimally penetrate inside the rope. Moreover, achieving sizeable rope lengths which are optimally impregnated with the liquid material along a significant, preferably entire, length thereof is hardly possible. Especially for thick ropes, e.g. ropes having an effective diameter of more than 10 mm and even more than 20 mm, it was observed that the liquid material hardly penetrates fully the rope reaching the core of the rope also. Such an uneven distribution of the liquid material inside the rope may in turn cause a reduced life time thereof and even variations in rope strength along its length during its use.

To partly solve the above drawbacks and in particular the inhomogeneous penetration, methods were devised where ropes were assembled from previously coated fibers or coated strands containing fibers. Such a method is for example disclosed in DE 749 220. Therein, before constructing a rope, the individual elements of the rope, e.g. fibers, yarns of strands, are coated or impregnated by passing several filaments through an impregnation bath and thereafter combining them in an elongated nozzle tube. However, processes such as the one of DE 749 220 are very complicated and extremely polluting. Also, it came as a surprise for such methods that in spite of distributing a liquid material on each fiber or strand of the rope, the exterior of the rope assembled from said fibers and/or strands contained less liquid material than the core of the rope. Hence, even for such methods the degree of rope impregnation can be optimized.

Accordingly, the object of the present invention may be to provide a method for coating a rope which shows the above mentioned disadvantages to a lesser extent. In particular, the present invention aims to provide a method for more uniformly impregnating a rope with a liquid material and a device for carrying out said method.

SUMMARY OF THE INVENTION

The invention proposes a method for impregnating a liquid material into a rope comprising a plurality of fibers and interstices between said fibers, said method comprising the steps of:

a. Providing a liquid material in a tank, said liquid material defining a level of liquid in said tank;
b. Providing an impregnation unit containing a chamber at least partially immersed in said liquid material, said chamber comprising:
   i. a rope-inlet for tightly receiving the rope, wherein said rope-inlet is positioned below the level of liquid;
   ii. a rope-outlet for tightly discharging said rope;
   iii. a vacuum-outlet; and
c. Providing a vacuum-device operatively connected to said vacuum-outlet for lowering the pressure in said chamber below the atmospheric pressure;
d. Passing the rope through the liquid material in the tank and then inside and outside said chamber via the rope-inlet and rope-outlet, while maintaining the pressure inside said chamber below the atmospheric pressure to force the liquid material to fill at least part of said interstices between the fibers of the rope by penetrating between said fibers.

It was observed that the method of the invention has an increased safety factor and offers good reproducibility as well as a high level of ergonomics. Ropes with a uniform distribution of the liquid material, as observed on a cross-section of the rope, may be produced. The method of the invention also seems less sensitive to the type of the liquid material used for impregnation or to the characteristics of the rope to be impregnated, e.g. the construction, diameter or material thereof. In particular it was observed that with the method of the invention the efficiency of the impregnation was optimized, e.g. the liquid material reached the core of the rope, which in turn led to a larger quantity of liquid material present inside said rope than it was obtained heretofore. Another important advantage of the method of the invention is that said method can be applied continuously.

The invention also relates to a device for carrying out the method of the invention, which comprises:

a. A tank comprising a liquid material, said liquid material defining a level of liquid in said tank;
b. An impregnation unit containing a chamber at least partially immersed in said liquid material, said chamber comprising:
   i. a rope-inlet for tightly receiving the rope, wherein said rope-inlet is positioned below the level of the liquid material in the tank;
   ii. a rope-outlet for tightly discharging said rope;
   iii. a vacuum-outlet; and
c. A vacuum-device operationally connected to said vacuum-outlet for lowering the pressure in said chamber below the atmospheric pressure.

The device of the present invention makes use of vacuum to force the liquid material from the tank inside the rope, between the fibers forming the rope, such that said liquid material fills voids, pores and interstices present in the rope and effectively coats the individual fibers of which the rope is composed. In other words, in order to force the liquid material to penetrate inside the rope and in-between the fibers of the rope to fill out said voids, pores and interstices, a pressure difference is created in respect with the atmospheric pressure with the lower pressure being in the chamber. This pressure difference forces the liquid material to flow inside the chamber between the fibers of the rope and thus filling out said voids, pores and interstices. Therewith in order for the device to operate properly, a pressure difference Δ, wherein $\Delta = P_{atm} - P_{chamber}$, needs to be maintained throughout the impregnation process, with a pressure in the chamber ($P_{chamber}$) that is lower than the pressure outside the chamber. Typically, the pressure outside the chamber is the atmospheric pressure, hereinafter denoted as $P_{atm}$. Preferably Δ is maintained at a constant level to ensure for a uniform impregnation of the rope. Δ can vary widely depending on e.g. the rope characteristics, e.g. rope tightness, diameter and materials used; but also time needed for impregnation and characteristics of the liquid material, e.g. viscosity. For example, the higher the diameter of the rope or the tightness of the rope, applying a higher Δ can be considered. On the other hand when dealing with a rope having a specific construction, applying a higher Δ may imply that more liquid material impregnates the rope. In one embodiment, it is preferred that Δ is at least 0.05 bar, more preferably at least 0.1 bar, most preferably at least 0.5 bar. For example, a Δ of 0.05 bar when the $P_{atm}$ is 1 bar would correspond to a $P_{chamber}$ of 0.95 bar. Although not limited for upper values, for practical reasons, preferably Δ is at most 10 bar, most preferably at most 5 bar, most preferably at most 3 bar.

BRIEF DESCRIPTION OF THE DRAWINGS

The invention is further illustrated by the following drawings.

DETAILED DESCRIPTION OF THE INVENTION

Figure 1:
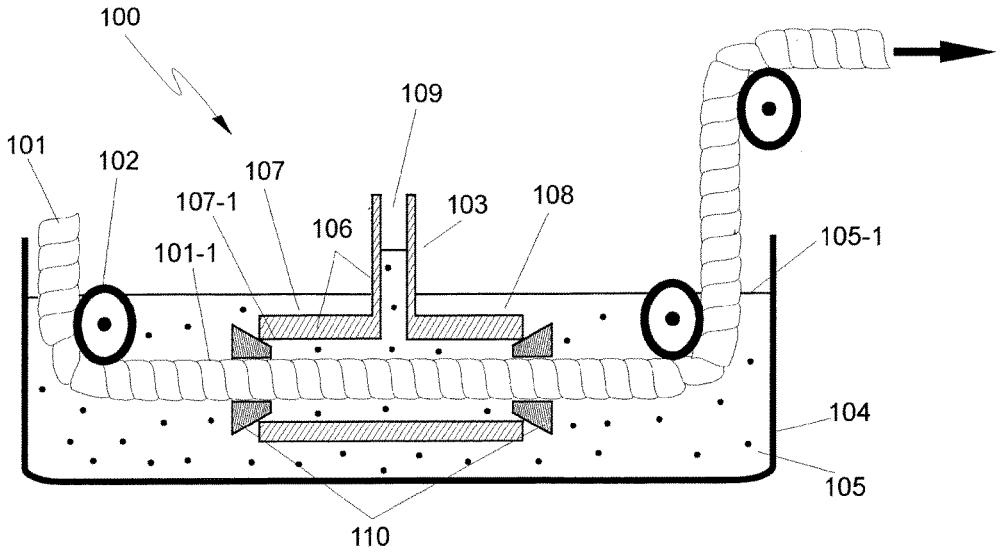
FIG. 1 is a schematic representation of the device for carrying out the method of the invention.

The invention proposes a method for impregnating a liquid material into a rope comprising a plurality of fibers and interstices between said fibers. With reference to FIG. 1-1, the device (100) for carrying out the method of the invention comprises a supplying device (not shown) such as a bobbin or an unwinder from which the rope (101) to be impregnated is supplied through rollers (102) to the impregnation unit (103). The impregnation unit (103) is immersed into a tank (104) comprising a liquid material (105) to be impregnated into the rope (101).

The impregnation unit (103) comprises chamber (106), the chamber having preferably an inversed T shape and containing a rope-inlet (107) for receiving rope (101); a rope-outlet for discharging rope (101) and a vacuum-outlet (109). A vacuum device (not shown) such as for example a vacuum pump is operatively connected to the vacuum-outlet (109) via a system of pipes for example and is used to reduce the pressure inside the chamber (106) below the atmospheric pressure. The reduced pressure inside the chamber (106) will cause a flow of the liquid material (105) from the tank (104) into the chamber (106) between the fibers of the rope (101). During the method of the invention, the liquid material (105) is continuously transported from the tank (104) into the chamber (106) and may also accidentally enter the vacuum outlet causing a pollution of the vacuum device. To prevent such pollution, a buffer vessel (not shown) may be provided preferably between the vacuum outlet and the vacuum device. Also a feedback system (not shown) may be utilized where the liquid material from the buffer vessel is fed back to the tank (104) to replenish the amount of the liquid material (105).

The liquid material (105) has a defined liquid level (105-1) inside the tank (104) which is preferably maintained constant during the impregnation process. This can be carried out by using for example the feedback mechanism described hereinabove provided with a liquid-feeding system (not shown) and a liquid level detector which triggers a replenishing mechanism when the level (105-1) drops below a set point.

The rope-inlet (107) and the rope-outlet (108) tightly receive and discharge the rope (101), respectively. This may be carried out by using sealing means (110) or any other type of valves (not shown in figures), e.g. pneumatic diaphragm valves, of suitable character so that the pressure in the chamber (106) may be lowered and maintained at the desired level.

As shown in FIG. 1-1, the rope (101) having an outer-surface (101-1) is received by the rope-inlet (107) of the chamber (106), said rope-inlet having an inner wall (107-1). The sealing means (110) is positioned between the rope outer-surface (101-1) and the inner wall (107-1) of the rope-inlet (107) to provide a tightly sealing thereof.

Figure 2A:
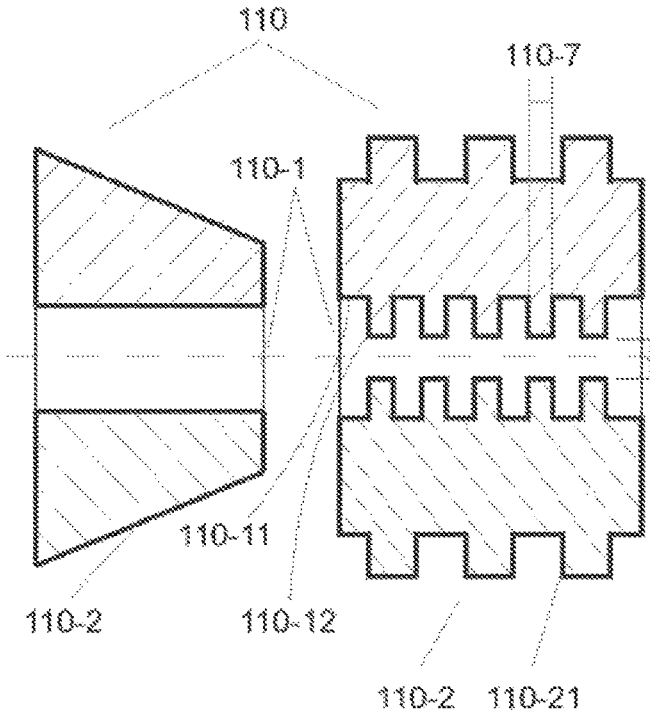
FIG. 2 is a picture showing the difference between a rope impregnated with known methods and a rope impregnated using the device of the invention.
Figure 2B:
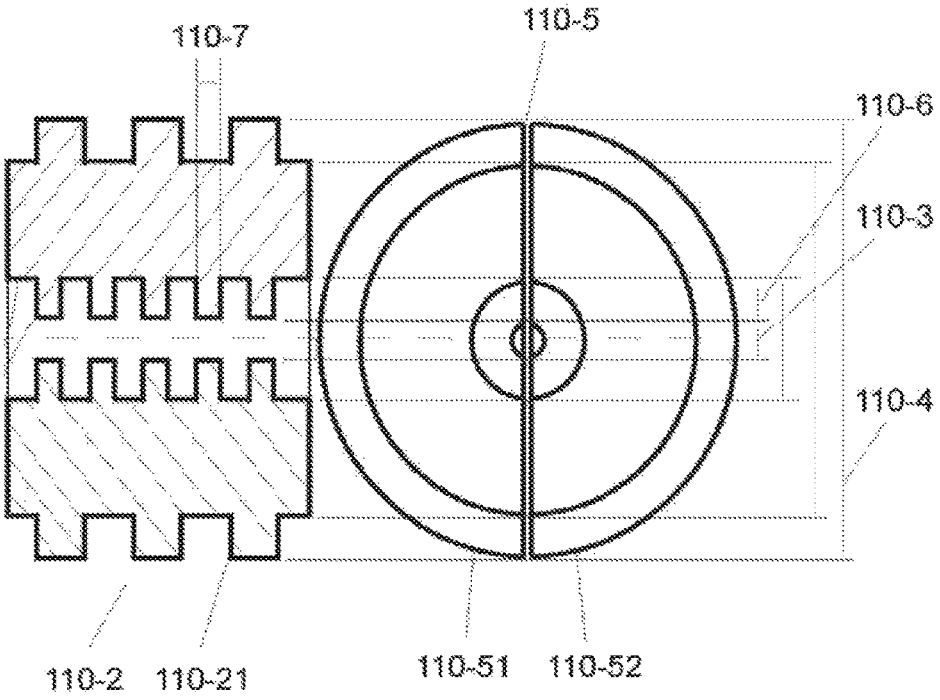

A preferred sealing means is a tapered sealing device having for example a shape of a frustum of a cone (FIG. 1-2A). Such a shape of the tapered sealing device may ease its installment while being less sensitive to the size of the rope used or to the dimensions of the rope-inlet or of the rope-outlet contained by the impregnation unit. Moreover, such a device usually has good sealing properties. With reference to FIG. 1-2A, the tapered sealing device contains an admission inlet (110-1) with lateral dimensions, e.g. diameter, adjusted to accommodate the rope such that a tight fit between said device and the rope is achieved. The tapered region (110-2) also has dimensions adjusted to accommodate the rope-inlet (107) or the rope-outlet (108), respectively, such that a tight fit between said device and the respective inlet or outlet is achieved. The skilled person can routinely determine the necessary dimensions of said admission inlet (110-1) and of said tapered region (110-2) with due regard to the size of the rope to be impregnates as well as of the rope-inlet and of the rope-outlet of the impregnation unit such that an optimum tight fit is achieved.

A second preferred embodiment of a sealing means is a sealing device having essentially a cylindrical shape (FIGS. 1-2B) and containing an admission inlet (110-1) for receiving the rope, wherein said device has an inner surface (110-11) and a outer surface (110-2) wherein said inner surface and/or said outer surface are provided with a plurality of protrusions (110-12) and (110-21), respectively, said protrusions preferably having a cross-section defined by a height (110-6) and a width (110-7). Although referred to as essentially cylindrical shape, is it understood that the shape of the sealing device may vary in order to tightly engage the rope and the inner wall of the rope-inlet and of the rope-outlet, e.g. said sealing device may have two, preferably parallel, bases connected to each other by at least one lateral face, wherein said parallel bases may be polygons or may have a rounded shape, e.g. elliptic or circular. The protrusions of the inner surface, hereinafter referred to as the inner protrusions, define an effective inner diameter (110-3) which is the smallest distance between the tips of two opposite inner protrusions. The protrusions of the outer surface, hereinafter referred to as the outer protrusions, define an effective outer diameter (110-4) which is the largest distance between the tips of two opposite outer protrusions. The sizes of the inner and/or outer protrusions are adjusted to provide a tight fit with the outer surface of the rope and with the inner wall of the rope-inlet and/or of the rope-outlet.

Is to be understood that the above-mentioned embodiments of the sealing means are only representative, without imposing any limitation on the shape or size of the sealing means. Any sealing means, such as gaskets, rubber sealing and the like, which ensures for a tight fitting between the rope outer surface and the inner wall of the rope-inlet and of the rope-outlet may be used. Moreover, the described embodiments should not be understood as being limited to the shapes and the sizes mentioned thereto. It is to be understood that the profiles of the rope-inlet and of the rope-outlet, as well as when applicable the profiles of the admission inlets of the sealing means, are determined by the profile of the rope to be impregnated. The skilled person can routinely determine such profiles.

By tightly receiving or discharging the rope it here understood that the liquid material (105) for impregnating the rope (101) which is stored in the tank (104) mainly flows from said tank (104) into the chamber (106) through the rope (101) between the fibers of said rope. The sealing means (110) preferably prevent the liquid material (105) to flow into the chamber (106) through an eventual opening between the sealing means and the inner wall of the rope-inlet or rope-outlet, respectively. By the term "mainly flows" is herein understood that leakages are acceptable wherein the liquid material can flow, percolate or exude through an eventual space between the sealing means and the surface of the rope. It was observed that such embodiment may enable the manufacturing of a rope which not only is well impregnated but also optimally coated.

In one embodiment, the sealing means are adapted such that the rope-inlet and the rope-outlet are hermetically receiving and hermetically discharging, respectively, the rope. By hermetically receiving or discharging the rope is herein understood that the flow of liquid material between the sealing means and the surface of the rope is prevented in order to force most of the liquid material to penetrate the rope. The advantage of such an embodiment is that an optimally impregnated rope may be obtained.

The skilled person knows how to obtain a tighter, e.g. hermetical, fitting or a looser fitting between the sealing means and the rope surface by for example utilizing various known embodiments of valves or sealing means but preferably those disclosed hereinabove.

It is further preferred that the sealing means does not deform the rope (101) to be impregnated, by for example exerting a compressing action on said rope (101), since such deformation may minimize or even close the interstices between the fibers forming the rope, impeding therefore the flow of the liquid material (105) inside the chamber (106) between the fibers of said rope. To avoid such deformation, the sealing means may be constructed out of a resilient material, however, flexible enough to ensure for a minimized deformation of the rope passing thereto. Example of suitable materials for constructing said sealing means include widely known thermoplastic and thermosetting materials, most preferred being ones manufactured from rubber-based materials, i.e. having elastic properties. It was also observed that a suitable construction of the sealing means, such as the one of the second preferred embodiment presented hereinbefore, may minimize the deformation of the rope (101) passing through the sealing means. Avoidance of rope deformations may be achieved for example by adjusting the height (110-6) of the inner protrusions (110-12) and/or their width (110-7) to ensure for enough flexibility thereof.

Preferably, the sealing means are halved, i.e. they contain two, preferably symmetrical, parts (110-51) and (110-52) which engage each other in a tight fit such that an eventual gap (110-5) between the parts is minimized. Such a construction allows for an optimum installation thereof.

According to the invention, the rope-inlet is positioned below the level (105-1) of the liquid material (105). Although this ensures an optimum flow of the liquid material (105) between the fibers of the rope (101), it is also envisaged that in case the rope (101) needs to be impregnated only partially, the rope-inlet may be at least partially immersed in said liquid material. Furthermore, although the rope-outlet is shown in FIG. 1-1 as positioned below the level (105-1) of the liquid material (105), it is to be understood that said rope-outlet may be also positioned above said level of the liquid material. Such an embodiment offers several advantages, such as a cleaner impregnation process for example.

The rope (101) is passed through the liquid material (105), through the impregnation unit (103) and then out of the tank (104) via a system of driven and/or idle belts, e.g. caterpillars, rollers and/or winches. It is preferred that during the impregnation process, the rope (101) is kept under a tension Σ, wherein the tension Σ is sufficient enough to at least keep said rope taut. When the rope (101) is passed continuously through the liquid material and impregnation unit, the tension Σ should be high enough to ensure a preferably constant haul of said rope during the impregnation process. Preferably, said tension Σ is low enough not to deform the rope to the extent that the flow of liquid material (105) from the tank (104) into the chamber (106) between the fibers of the rope (101) is impeded.

Any liquid material suitable for rope impregnation can be used in accordance with the present invention. For example melts of polymeric materials such as those used typically in injection molding processes can be used for impregnation; suitable examples thermoplastics, thermosets and elastomers, more in particular polyolefins and polyolefin copolymers such as polypropylenes and polyethylenes, e.g. low density polyethylene (LDPE); liquid crystal polymers; acrylonitrile butadiene styrene copolymers (ABS); styrene-acrylonitrile copolymers (SAN); polyvinyl acetate (PVA) and ethyl-vinylk acetate (EVA) polyacrylates; polyamides; polybutadienes; epoxies; polyimides; silicon- and fluorosilicone-based rubbers and the like. Also materials such as pitch, tar, asphalt, or other hydrocarbon or bituminous compounds may be used. Also liquid formulation such as suspensions of various solids into a liquid medium may be used. Preferably the liquid medium is water. Suitable examples of solid materials suitable for manufacturing said suspensions, and in particular water based suspensions, include polyurethanes, epoxies, waxes, rubbers and silicone based materials.

The liquid material needs also to be able to flow under the pressure difference Δ between two locations, e.g. from the tank inside the rope, through a narrow passage, e.g. the passage dictated by the voids, pores and interstices of the rope. It is known that the extent to which a rope is impregnated depends upon at least three factors, namely the porosity of the rope, i.e. the amount and size of voids, pores and interstices thereof; the flow behavior of the liquid material; and the time allowed for impregnation, i.e. the speed with which the rope passes through the impregnation device. The flow behavior of a liquid material depends on its viscosity or in other words, the less viscous the liquid material is the easier it flows. The viscosity of the liquid materials used in accordance with the invention can vary between wide ranges, e.g. between water-like viscosities for diluted water based suspensions to melt-like viscosities for melts of polymeric materials. It is to be understood that the viscosity is not the limiting factor for carrying out the present invention as even higher viscosity liquid materials can be forced between the fibers of a rope by applying a larger pressure difference Δ between the atmospheric pressure and the pressure of chamber (106) and/or by using ropes having larges interstices between the fibers thereof.

By rope it is understood an elongated body having a length much larger than its lateral dimensions of for example width and thickness or diameter. The rope to be used in accordance with the invention may have a cross-section which is rounded or polygonal or combination thereof. Preferably, ropes having an oblong cross-section or a circular cross-section are used in the present invention as it is easier to provide a tight fitting into the impregnation unit for such ropes. By diameter of the rope is herein understood the largest distance between two opposite locations on the periphery of a cross-section of the rope. The diameter of the rope used in accordance with the invention can vary between large limits, e.g. from diameters specific to fishing lines of less than 1 mm, to diameters specific to off-shore mooring lines of more than 200 mm and even more than 500 mm. Although not a limiting factor, it was observed that good results were obtained when said diameter of said rope is at least 10 mm, more preferably at least 20 mm, most preferably at least 30 mm. Also good impregnation was achieved for larger diameter ropes, i.e. ropes having a diameter of at least 80 mm, preferably at least 100 mm which otherwise are difficult to be impregnated with the known methods or even manually.

The rope is preferably passed through the impregnating unit (103) with a speed that is adjusted with due regard to the diameter and construction of the rope, the pressure difference applied and the characteristic of the liquid material. The skilled person can easily adjust said speed to achieve an optimum impregnation.

Preferably, the rope used in accordance with the invention is a non-impregnated rope, i.e. a rope which has not yet been subjected to an impregnation step or steps; or a rope which was subjected to a light impregnation. In other words, the preferred rope utilized herein is a rope which contains less than 10 wt % based on the total weight of the rope of components other than the fibres, more preferably less than 5 wt %, most preferably less than 1 wt %. It was observed that using such a rope may lead to better impregnation.

The rope used in accordance with the invention comprises a plurality of fibers and interstices between said fibers. Preferably the fibers are grouped or bundled into yarns which preferably are subsequently grouped or bundled into strands. Preferably the ropes used in accordance with the present invention comprise a plurality of strands, said strands comprising a plurality of yarns containing said fibers. Preferred constructions of ropes which entail the presence of interstices between the fibers of the rope include braided ropes and laid ropes. The tightness of the rope also determines the size of the interstices between the fibers forming thereof; the tighter the rope is the smaller the interstices may be. The tightness of the rope may be related for a braided rope to the braiding period and for a laid rope to the twist factor; whereas the smaller said braiding period or the larger said twist factor, the tighter the rope.

The fibers contained by the rope used in the present invention may be natural or synthetic fibers, i.e. fibers produced out of a natural or a synthetic material. Natural materials may include metals but also cotton, hemp, abaca, bamboo, coir, flax (linen), jute, kapok, kenaf, pina, raffia, ramie, sisal, wood. Also animal fibers may be used to produce the rope to be impregnated in accordance with the present invention such as alpaca, angora, byssus, camel hair, cashmere, catgut, silk, wool, yak and the like.

Preferably, the ropes used in the present invention are synthetic ropes, i.e. ropes containing synthetic fibers. Said synthetic ropes preferably contain at least 50 wt %, based on the total weight of the rope, synthetic fibers, more preferably at least 70 wt %, even more preferably at least 90 wt %, most preferably all fibers contained by said synthetic ropes are synthetic fibers. It was observed that by using such rope, the best impregnation results were achieved. By synthetic fibers are herein understood fibers manufactured out of a synthetic material such as cellulose, e.g. acetate, triacetate, rayon, but also polymeric materials. Preferably the synthetic fibers are manufactured from a polymer chosen from the group consisting of polyamides and polyaramides, e.g. poly(p-phenylene terephthalamide) (known as Kevlar®); poly(tetrafluoroethylene) (PTFE); poly{2,6-diimidazo-[4,5b-4',5'e] pyridinylene-1,4(2,5-dihydroxy)phenylene} (known as M5); poly(p-phenylene-2, 6-benzobisoxazole) (PBO) (known as Zylon®); liquid crystal polymers (LCP); poly (hexamethyleneadipamide) (known as nylon 6,6), poly(4-aminobutyric acid) (known as nylon 6); polyesters, e.g. poly(ethylene terephthalate), poly(butylene terephthalate), and poly(1,4 cyclohexylidene dimethylene terephthalate); polyvinyl alcohols; and also polyolefins e.g. homopolymers and copolymers of polyethylene and/or polypropylene. The preferred synthetic fibers are polyaramide fibers and high or ultra high molecular weight polyethylene (HMWPE or UHMWPE) fibers. Preferably the HMWPE fibers are melt spun and the UHMWPE are gel spun, e.g. fibers manufactured by DSM Dyneema, NL. An example of a melt spinning process for producing melt spun HMWPE fibers is disclosed in EP 1,350,868

In a preferred embodiment, the rope used in the present invention contains UHMWPE fibers, more preferably gel spun UHMWPE fibers. Preferably the UHMWPE used to manufacture the UHMWPE fibers has an intrinsic viscosity (IV) of at least 3 dl/g, more preferably at least 4 dl/g, most preferably at least 5 dl/g. Preferably said IV is at most 40 dl/g, more preferably at most 25 dl/g, more preferably at most 15 dl/g. The IV may be determined according to ASTM D1601(2004) at 135° C. in decalin, the dissolution time being 16 hours, with BHT (Butylated Hydroxy Toluene) as anti-oxidant in an amount of 2 g/l solution, by extrapolating the viscosity as measured at different concentrations to zero concentration. Examples of gel spinning processes for the manufacturing of UHMWPE fibers are described in numerous publications, including EP 0205960 A, EP 0213208 A1, U.S. Pat. No. 4,413,110, GB 2042414 A, GB-A-2051667, EP 0200547 B1, EP 0472114 B1, WO 01/73173 A1, EP 1,699,954 and in "*Advanced Fibre Spinning Technology*", Ed. T. Nakajima, Woodhead Publ. Ltd (1994), ISBN 185573 182 7.

The fibers contained by the rope used in the present invention may be continuous fibers, also referred to in the art as filaments, or discontinuous fibers, also referred to in the art as staple fibers.

The method of the invention may also contain a drying step when a liquid material containing volatile mediums is used, or a solidifying step when a liquid material which is a melt is used. It was observed that the rope coated with the method of the invention contained an optimum distribution of solids, i.e. the materials left in the rope after drying or solidifying, and/or may even contain a higher amount of solids.

Furthermore, the present invention allows for a simplification of the entire method and of the device for impregnation as well as simplified technical service thereof.

The invention also relates to a 1-step impregnated rope obtainable by the method of the invention.

By 1-step impregnated rope is herein understood a rope which is impregnated as produced, i.e. directly after being constructed. For example a process wherein a rope containing a plurality of strands is firstly open, i.e. the individual strands are spread apart, then immersed or dipped into a liquid material for impregnation and then reassembled into its initial form, is not a 1-step process but at least a 2-steps process wherein the rope first is opened and subsequently impregnated. In contradistinction with such a process, the method of the invention allows for a 1-step impregnation process since the rope is not firstly opened but used as produced.

The rope of the invention can be utilized in a variety of applications such as tugging, mooring, hoisting/lifting, installation, offshore, commercial fishing, sailing and yachting, forestry, arborists, diving, rescue and safety, station keeping, dredging, climbing/rappelling and sailing.

The invention will be further explained with the help of the following example and comparative experiment.

EXAMPLE

A rope having an essentially circular cross-section with an effective diameter of about 21 mm was braided from 12 principal strands, each principal strand containing 7 laid secondary strands, each secondary strand containing a bundle of 15 yarns having 1760 dtex and comprising UHMWPE fibers. The yarns were sold by DSM Dyneema, NL, under the name of Dyneema® SK75. The primary strands were braided with a braiding period of 150 mm. The secondary strands were twisted to form a primary strand with a twist factor of 15 twists per m. The yarns were twisted to form a secondary strand with a twist factor of 13 twists per m.

The rope was unwound from a coil and pulled through a tank containing a liquid material. The liquid material was a water dispersion and contained a liquid phase and a solid phase and had a viscosity of about 90 mPa*s (Brookfield viscosity, cup 1, 50 rpm, 25° C.). The solid phase amounted to about 50 wt % of the total weight of said liquid material.

From the tank, the rope entered an impregnation unit, which was completely submerged into the liquid material, through a rope-inlet and then it exited said impregnation unit through a rope-outlet. A hermetical seal was ensured between the rope and the impregnation unit by sealing means such as the ones depicted in FIG. 1-2B. The height and the width of the inner protrusions was adjusted to ensure for enough flexibility of said protrusions in order to avoid the rope being compressed, though to ensure a hermetical fitting with the rope and prevent the liquid material from oozing between the sealing means and the surface of the rope.

The rope was pulled through the impregnation unit with a linear speed of about 3 m/min while a vacuum pump connected to the vacuum outlet reduced the pressure inside the chamber of the impregnation unit to between −0.1 bar and −0.7 bar.

To avoid potential damages to the vacuum pump due to the excess of the liquid material in the chamber of the impregnation unit a buffer vessel was used. About 60 cm of rope was impregnated with the liquid material and after impregnation the rope was dried by allowing the liquid phase contained by the liquid material to evaporate.

The results are presented in Table.

Comparative Experiment

The rope of example 1 was coated dipping the rope into the liquid material and allowing said liquid material to diffuse into the rope. The results are presented in Table.

TABLE

| Sample | Pressure (bar) | Weight impregnated sample after drying (g) | (g/m) | Weight of the solid material in the impregnated rope after drying (wt %) |
|---|---|---|---|---|
| Ex. 1 | −0.5 | 157 | 265 | 52 |
| | −0.68 | 161 | 271 | 56 |
| C. Ex. | N/A | 125 | 231 | 33 |

The invention claimed is:

1. A method for impregnating a liquid material into a rope comprising a plurality of fibers and interstices between the fibers, wherein the method comprises the steps of:

(a) providing a liquid material in a tank, wherein the liquid material defines a level of liquid in the tank;

(b) providing an impregnation unit containing a chamber at least partially immersed in the liquid material, the chamber comprising:

(i) a rope-inlet positioned below the level of liquid in the tank for tightly receiving the rope;

(ii) a rope-outlet for tightly discharging the rope; and (iii) a vacuum-outlet;

(c) providing a vacuum-device operatively connected to the vacuum-outlet for lowering pressure in the chamber below atmospheric pressure;

(d) passing the rope through the liquid material in the tank and then inside and outside the chamber by the rope-inlet and the rope-outlet, respectively, while maintaining the pressure inside the chamber below atmospheric pressure to force the liquid material to fill at least part of the interstices between the fibers of the rope by penetrating between the fibers.

2. The method of claim 1, wherein step c) comprises maintaining a pressure in the chamber ($P_{chamber}$) lower than a pressure outside the chamber ($P_{atm}$) so as to establish a pressure difference $\Delta=P_{atm}-P_{chamber}$ of at least 0.05 bar.

3. The method of claim 1, which comprises providing the rope inlet and the rope outlet with a tapered sealing device having a shape of a frustum of a cone to thereby provide a tight fit of the rope with the rope inlet and rope outlet.

4. The method of claim 1, which comprises providing the rope inlet and the rope outlet with sealing device having an essentially cylindrical shape and containing an admission inlet for receiving the rope, wherein the sealing device has an inner surface and an outer surface, and wherein at least one of the inner surface and the outer surface is provided with a plurality of protrusions having a cross-section defined by a height and a width.

5. The method of claim 1, which comprises providing the rope inlet and the rope outlet with a sealing device adapted to allow the rope to be hermetically received and hermetically discharged by the rope inlet and the rope outlet, respectively.

6. The method of claim 1, wherein steps (a)-(d) are practiced continuously.

7. The method of claim 1, wherein the liquid material is selected from the group consisting of polyolefin homopolymers; polyolefin copolymers; liquid crystal polymers; acrylonitrile butadiene styrene copolymers (ABS); styrene-acrylonitrile copolymers (SAN); polyvinyl acetate (PVA) polyacrylates, ethyl-vinyl acetate (EVA) polyacrylates; polyamides; polybutadienes; polyurethanes; epoxies; waxes; polyimides; silicon-based rubbers, fluorosilicone-based rubbers; pitch; tar; asphalt; hydrocarbon compounds, bituminous compounds; and suspensions thereof.

8. The method of claim 1, wherein the rope has a diameter which is at least 20 mm.

9. The method of claim 1, wherein the rope passing into the chamber of the impregnation unit through the rope inlet is a non-impregnated rope.

10. The method of claim 1, wherein the rope comprises at least 50 wt % of synthetic fibers, based on total weight of the rope.

11. The method of claim 1, wherein the rope comprises UHMWPE fibers.

12. The method of claim 1, wherein the fibers of the rope are grouped or bundled into yarns, and wherein the yarns are subsequently grouped or bundled into strands.

13. The method of claim 11, wherein the UHMWPE fibers are gel-spun UHMWPE fibers.

14. An apparatus for impregnating a liquid material into a rope comprised of a plurality of fibers and interstices between the fibers, wherein the apparatus comprises:

(a) a tank comprising a liquid material which defines a level of liquid in the tank;

(b) an impregnation unit containing a chamber at least partially immersed in the liquid material, the chamber comprising:

(i) a rope-inlet positioned below the level of the liquid material in the tank for tightly receiving the rope;

(ii) a rope-outlet for tightly discharging said rope; and (iii) a vacuum-outlet; and (c) a vacuum device operatively connected to the vacuum outlet for lowering pressure in the chamber below atmospheric pressure, wherein passing the rope through the liquid material in the tank and then inside and outside the chamber by the rope-inlet and the rope-outlet, respectively, while maintaining the pressure inside the chamber below atmospheric pressure forces the liquid material to fill at least part of the interstices between the fibers of the rope by penetrating between the fibers.

15. The apparatus of claim 14, wherein the vacuum device maintains a pressure in the chamber ($P_{chamber}$) which is lower than a pressure outside the chamber ($P_{atm}$) so as to establish a pressure difference $\Delta=P_{atm}-P_{chamber}$ of at least 0.05 bar.

16. The apparatus of claim 14, wherein each of the rope inlet and the rope outlet comprises a tapered sealing device having a shape of a frustum of a cone to thereby provide a tight fit of the rope with the rope inlet and rope outlet.

17. The apparatus of claim 14, wherein each of the rope inlet and the rope outlet comprises a sealing device having an essentially cylindrical shape and containing an admission inlet for receiving the rope, wherein the sealing device has an inner surface and an outer surface, and wherein at least one of the inner surface and the outer surface is provided with a plurality of protrusions having a cross-section defined by a height and a width.

18. The apparatus of claim 14, wherein each of the rope inlet and the rope outlet comprises a sealing device adapted to allow the rope to be hermetically received and hermetically discharged by the rope inlet and the rope outlet, respectively.

* * * * *